US005613549A

United States Patent [19]

Dolwani

[11] Patent Number: 5,613,549

[45] Date of Patent: Mar. 25, 1997

[54] METHOD AND APPARATUS FOR SELECTIVELY SEALING AND SECURING A SENSOR OF A SEALING PLUG TO A PART

[76] Inventor: Ramesh J. Dolwani, 10071 Water Ford La., Alta Loma, Calif. 90701

[21] Appl. No.: 345,825

[22] Filed: Nov. 21, 1994

[51] Int. Cl.[6] ..... F28F 7/00

[52] U.S. Cl. ..... 165/11.1; 165/71

[58] Field of Search ..... 165/11.1, 71; 285/12, 285/901

[56] References Cited

U.S. PATENT DOCUMENTS

| | | | |
|---|---|---|---|
| 1,581,480 | 4/1926 | Andersen et al. . | |
| 1,609,911 | 12/1926 | Marsh . | |
| 1,667,026 | 4/1928 | Boyce . | |
| 1,772,568 | 8/1930 | Schlaich . | |
| 1,776,170 | 9/1930 | Thimblethorpe . | |
| 1,815,642 | 7/1931 | Zubaty . | |
| 1,985,702 | 12/1934 | Wachowitz | 165/11.1 |
| 3,100,391 | 8/1963 | Mansfield . | |
| 3,255,631 | 6/1966 | Franks . | |
| 3,581,568 | 6/1971 | Pfefer . | |
| 3,845,661 | 11/1974 | Hollweck et al. . | |
| 4,098,662 | 7/1978 | Schell et al. | 165/11.1 |
| 4,135,549 | 1/1979 | Baker . | |
| 4,244,221 | 1/1981 | Scott . | |
| 4,679,582 | 7/1987 | Zwicker | 137/71 |
| 5,456,290 | 10/1995 | Haberman et al. | 165/71 |

FOREIGN PATENT DOCUMENTS

| | | | |
|---|---|---|---|
| 0975354 | 9/1975 | Canada | 165/71 |
| 1047840 | 12/1953 | France | 165/11.1 |
| 0271465 | 3/1914 | Germany | 165/11.1 |

*Primary Examiner*—Edward K. Look
*Assistant Examiner*—Mark Sgantzos
*Attorney, Agent, or Firm*—Dennis H. Lambert

[57] ABSTRACT

An adaptor-retainer for quickly and easily selectively securing either a temperature sensor or a sealing plug in an opening in an automotive vehicle radiator header, depending upon whether that vehicle is or is not to be provided with a temperature sensor. The adaptor-retainer includes a retainer bushing having an inner end adapted to be secured and sealed in the opening, and a threaded outer end. A sealing bushing is adapted to be engaged in the retainer bushing for sealing cooperation with either the sealing plug or the sensor, whichever is installed, and a threaded retainer cap is adapted to be engaged on the threads of the retainer bushing to secure and seal either the sealing plug or the sensor in the retainer bushing by clamping it between the retainer cap and the sealing bushing.

10 Claims, 3 Drawing Sheets

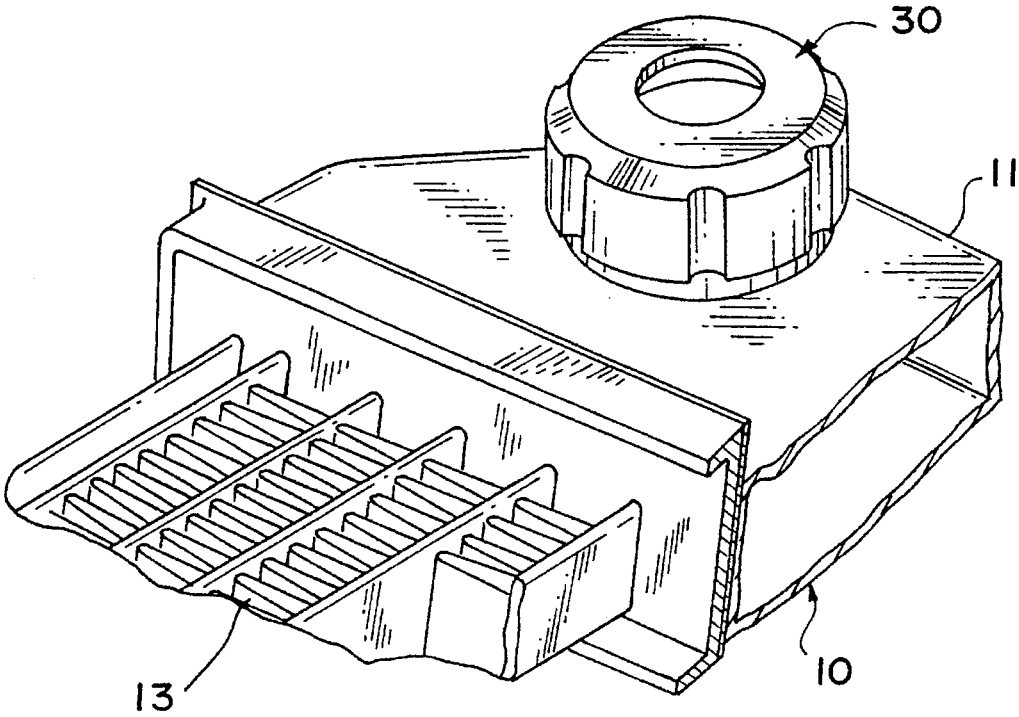
FIG. 3
FIG. 4
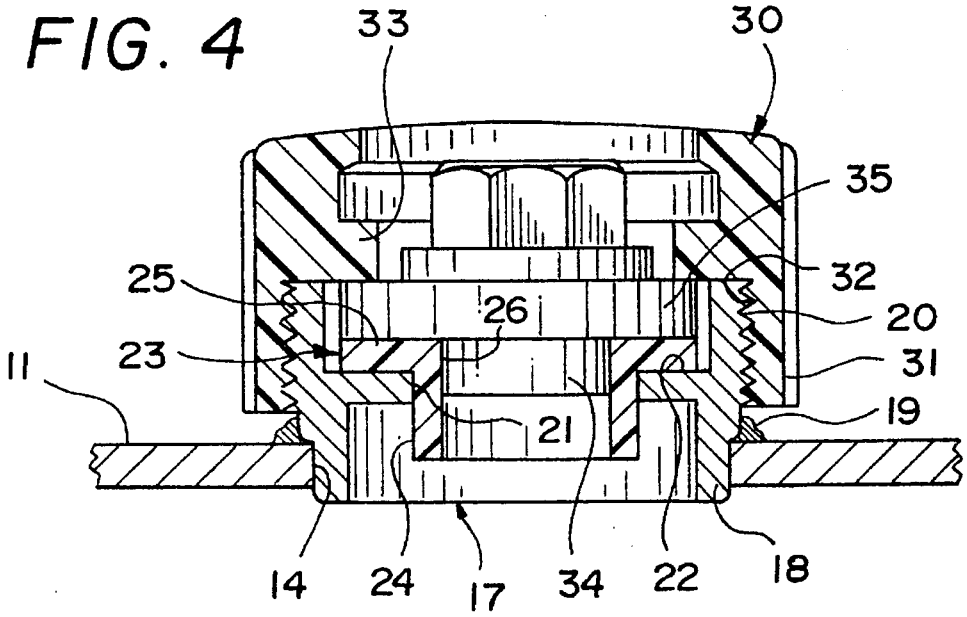

METHOD AND APPARATUS FOR SELECTIVELY SEALING AND SECURING A SENSOR OF A SEALING PLUG TO A PART

1. Field of the Invention:

This invention relates to devices for retaining sensors in place on an apparatus. More particularly, the invention relates to such a device for selectively retaining a closure plug or a temperature sensor in place on an automotive radiator.

2. Background of the Invention:

Modern automotive vehicles include a variety of specialized components, including sensors for monitoring engine temperature, fuel level and air/fuel mixture, oil pressure, and the like, and computer controls which may be responsive to conditions sensed by the sensors. Depending upon the conditions sensed by such devices, or the state of operation of the sensors and computers themselves, the vehicle may be rendered inoperative.

Some vehicles are sold with different option packages than the options included with other vehicles. For example, a temperature sensor may be provided on one vehicle, while it will not be provided on another vehicle of the same make and model. Both vehicles will, however, likely have the same radiator. In order to standardize production and minimize the number of parts which must be inventoried, and thereby reduce cost, automotive radiators typically have a standard opening in which either a plug or a sensor may be selectively mounted during manufacture so that the appropriate device can be installed on the radiator, depending upon what is called for by the options list for that vehicle.

In conventional systems, if the vehicle is not to be provided with a temperature sensor, a plug is press-fitted in the opening. On the other hand, if a temperature-sensing option is included, then a temperature sensor instead of a plug is press-fitted in the opening. While this enables some standardization and reduces the number of parts which must be inventoried, the press-fitted connections are prone to become loose over time and can lead to leakage and loss of coolant fluid, or even to inoperability of the sensor, if installed, and potentially to inoperability of the vehicle. Moreover, installation and removal of either the plug or the sensor is difficult, increasing the time and cost of repair and maintenance.

Accordingly, there is need for a system which not only enables standardization in manufacture and reduction in the number of parts which must be inventoried, but which also is simple and easy to install and remove and which is reliable in operation.

SUMMARY OF THE INVENTION

An object of the invention is, therefore, to provide an inexpensive adapter-retainer for a temperature sensor for use on automotive vehicle radiators, which enables standardization in manufacture and reduction in the number of parts which must be inventoried, and which also is simple and easy to install and remove and which is reliable in operation.

In accordance with the present invention, an opening is provided in the radiator tank or header in a conventional position, but instead of a press-fitted plug or a press-fitted sensor as used in the prior art, a retainer bushing is secured in the opening by soldering or brazing it in place or by use of an adhesive or other means, and either a plug or a sensor, as appropriate, is then mounted in the retainer bushing and secured in position by use of a screw cap threadably engaged on the retainer bushing. A sealing bushing is engaged between the retainer bushing and the plug or sensor, effecting a fluid-tight seal.

During manufacture or maintenance, it is a simple matter to insert either a plug or a sensor into the retainer bushing and to then thread the retainer cap into place. There is no danger of the parts vibrating loose, as they are prone to do in the conventional press-fitted assemblies, and if repair or replacement should be desired or necessary, a mechanic can easily remove one part and replace it with another, thereby reducing cost and at the same time improving reliability.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 3 is a fragmentary perspective view of a portion of a radiator and the adapter-retainer of the invention;

FIG. 4 is an enlarged view in section, taken along line 4—4 in FIG. 2.

DETAILED DESCRIPTION OF THE PREFERRED EMBODIMENTS

Figure 1:
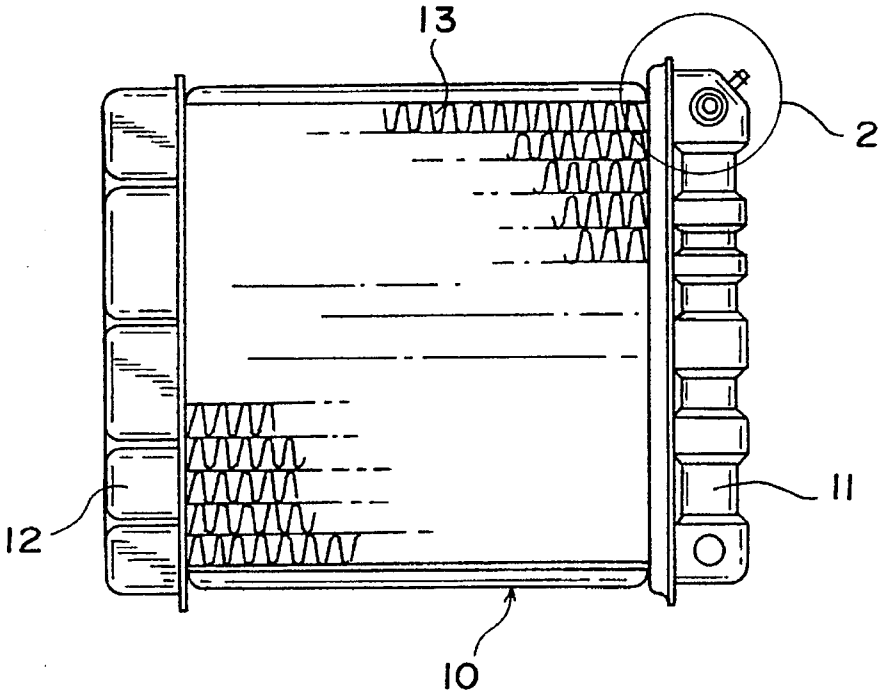
FIG. 1 is a front view in elevation of a radiator incorporating therein the adapter-retainer of the invention.
Figure 2:
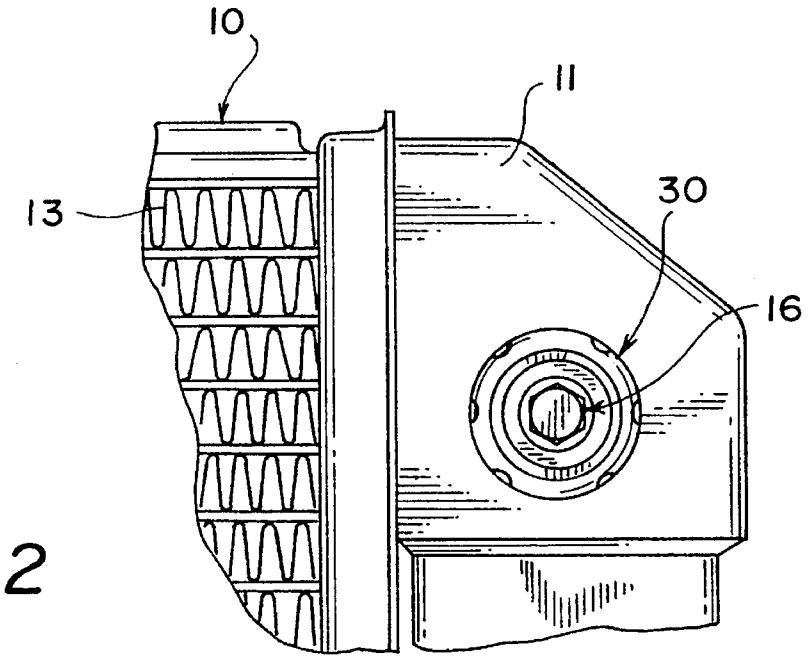
FIG. 2 is an enlarged view in elevation of the circled portion of FIG. 1.

Referring more specifically to the drawings, a radiator as used on an automobile or truck or the like, for example, is indicated generally at 10 in FIGS. 1–3. The radiator is of conventional construction and includes headers or tanks 11 and 12 at opposite ends, and a finned cooling section 13 extending between the headers. Various openings and connections are provided on the radiator for attachment of fluid flow couplings or other devices, all as conventionally practised.

In accordance with the present invention, an opening 14 is provided in the side of one of the headers 12, near its upper end, for attachment of a temperature sensor 15 (see FIG. 5) to those vehicles that are to be equipped with temperature measuring and indicating means. Alternatively, if the vehicle is not to be equipped with temperature sensing means, a plug 16 is secured in the opening to prevent leakage of coolant fluid from the header. The temperature sensor and plug are comparably shaped and sized so that they are readily interchangeable with each other without requiring modification of any of the parts.

Figure 5:
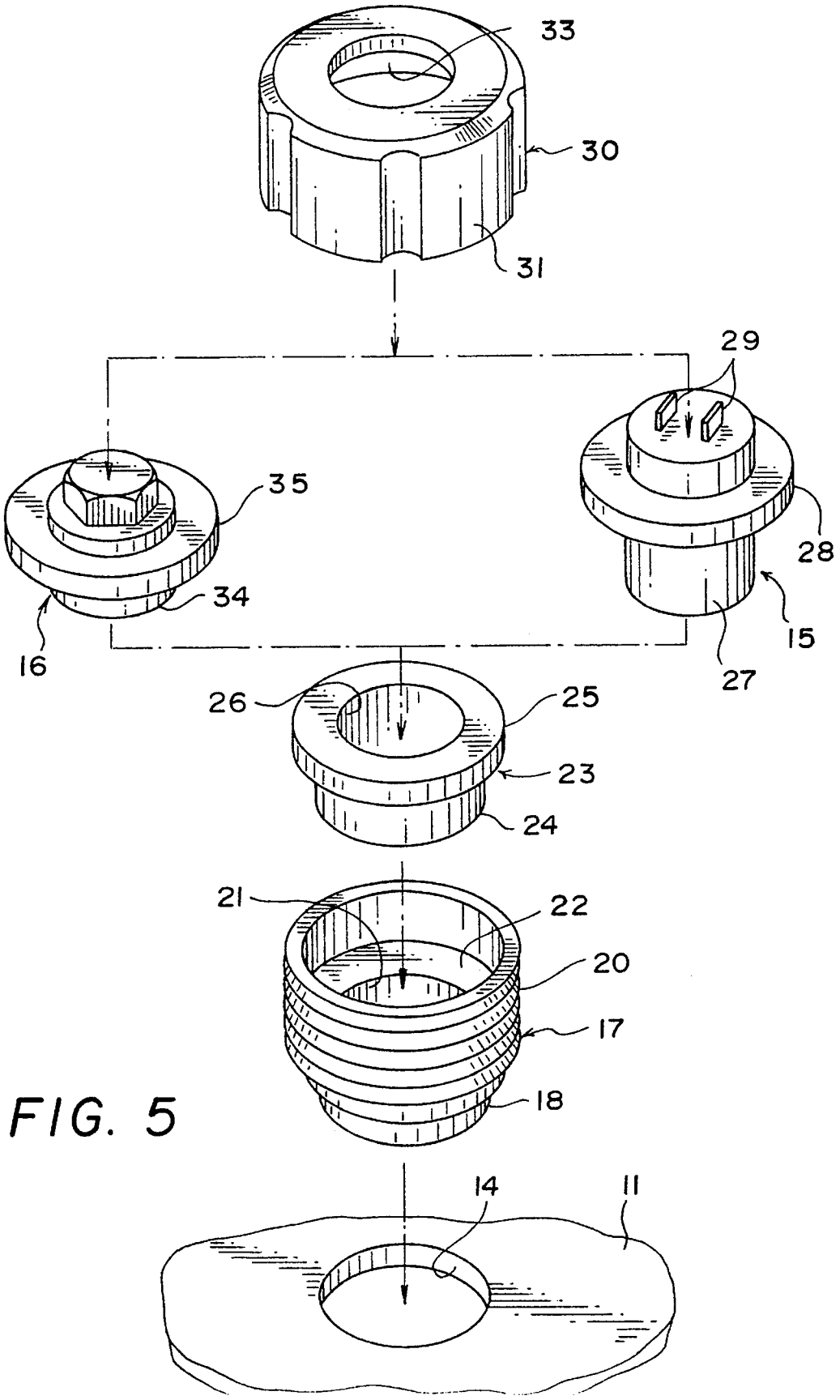
FIG. 5 is an enlarged, exploded perspective view of the adapter-retainer of the invention.

With particular reference to FIGS. 4 and 5, the construction of the adaptor-retainer of the invention can be clearly seen, and comprises a retainer bushing 17 that has one end 18 which fits closely in the opening 14 and, depending upon the material of the header, is suitably secured and sealed in the opening by soldering or brazing as at 19, or otherwise, as by use of an adhesive or the like. For instance, many existing radiators are made of copper and brass materials, and the retainer bushing could be soldered or brazed in place on these radiators. Other radiators, especially those of recent manufacture, include plastic and aluminum materials and the retainer bushing could be adhesively secured in place. Alternatively, the retainer bushing could be threaded in place, or secured by any other suitable means, and could even be molded into the header during manufacture of the header.

The retainer bushing 17 is threaded at its outer end 20, and has a reduced diameter opening 21 extending axially therethrough, defining an outwardly facing internal shelf or ledge 22.

A sealing bushing 23 of suitable material, such as rubber or the like, has a cylindrical body 24 adapted to extend into the opening 21, and has a radially enlarged annular sealing flange 25 adapted to overlie the annular shelf 22. An axial passage 26 extends through the sealing bushing for flow of fluid through the bushing, when desired.

As seen best in FIG. 5, the temperature sensor 15 has a cylindrical body 27 adapted to extend into the passage 26 of the sealing bushing 17, and an annular flange 28 adapted to overlie the flange 25 of the sealing bushing, Suitable connections 29 may be provided on the sensor for attachment of suitable leads to conduct signals to and from the sensor.

The sensor 15 is held in place by a threaded retainer cap 30 which has a depending skirt 31 with internal threads 32 that mate with the threads 20 on the retainer bushing 17. The cap includes an annular flange 33 of reduced diameter which engages the flange 28 of the sensor to clamp it in sealing engagement with the sealing bushing 23.

Alternatively, if the vehicle is not to be equipped with a temperature sensor, the plug 16 may be similarly secured in place to seal the opening 14 in the radiator header. The plug includes a solid cylindrical body 34 which extends in close-fitting relationship into the sealing bushing, and has an annular flange 35 which overlies the flange 25 of the sealing bushing. The annular flange 33 in the retainer cap engages against the flange 35 on the plug to clamp the flange 35 between the cap and the sealing bushing, effecting a fluid-tight seal between these parts.

As should be readily apparent from the foregoing, the adaptor-retainer of the invention is quick and easy to use, and effects a fluid-tight seal in a much more durable and reliable manner than conventional press-fitted plugs and temperature sensors.

For use on radiators having headers made of brass, the retainer bushing may comprise brass, the sealing bushing may comprise rubber or other suitable material, and the retainer cap may comprise plastic. The sealing plug could comprise plastic or aluminum or other suitable material. All the parts are inexpensive, easily manufactured and easy to use.

Although the invention has been illustrated and described in detail herein, it is to be understood that various changes and modifications may be made therein without departing from the spirit and scope of the invention as defined in the appended claims.

What is claimed is:

1. An adapter-retainer for selectively securing and sealing one of a sealing plug and a sensor in an opening in a first part, comprising:

a retainer bushing on said first part, having an inner end sealed relative to the opening, and an outer end with attaching means thereon, said retainer bushing having an axial passage extending therethrough and having means defining an axially facing annular sealing surface;

said sealing plug and sensor each having an annular flange thereon, said annular flange overlying the sealing surface when a respective one of the sealing plug and the sensor is inserted into the retainer bushing and against the sealing surface; and a retainer cap engaged on the retainer bushing to secure and seal one of the sealing plug and the sensor to the retainer bushing, said retainer cap having releasable attaching means thereon complemental to the attaching means on the retainer bushing for releasably attaching the retainer cap to the retainer bushing, and having a clamping surface which engages the annular flange on the respective sealing plug or sensor when it is installed to clamp it between the retainer cap and the sealing bushing, whereby said adapter-retainer enables quick and easy assembly and replacement of a sealing plug or sensor to the first part in a fluid-tight and secure manner.

2. An adapter-retainer as claimed in claim 1, wherein:

the first part comprises an automotive vehicle radiator header; and the sensor comprises a temperature sensor.

3. An adapter-retainer as claimed in claim 2, wherein:

the attaching means on the retainer bushing and retainer cap comprise threads; and the means defining an axially facing annular sealing surface on the retainer bushing comprises a reduced diameter annular flange in the axial passage extending therethrough.

4. An adapter-retainer as claimed in claim 3, wherein:

the retainer bushing is made of a metallic material for attachment to a radiator header made of a metallic material, and is secured in the opening by fastening means selected from the group consisting of soldering, brazing and adhesive.

5. An adapter-retainer as claimed in claim 3, wherein:

the retainer bushing is made of a plastic material injection molded into the radiator header.

6. An adapter-retainer as claimed in claim 4, wherein:

the retainer cap is made of plastic material.

7. An adapter-retainer as claimed in claim 5, wherein: the retainer cap is made of plastic material.

8. An adapter-retainer as claimed in claim 1, wherein:

sealing bushing is received in the passage in the retainer bushing, said sealing bushing having an axial passage therethrough and including an annular sealing flange adapted to overlie the annular sealing surface on the retainer bushing.

9. An adapter-retainer as claimed in claim 1, wherein:

the retainer bushing is formed as a separate part and is secured in said opening.

10. A method for quickly and interchangeably selectively securing and sealing one of a sealing plug and a sensor in an opening in a first part, comprising the steps of:

providing a retainer bushing in association with said opening;

providing interchangeable sealing plug and sensor fittings for attachment to said retainer bushing;

selecting one of said sealing plug and sensor for attachment to said retainer bushing and placing it in said retainer bushing; and applying a removable retainer cap to said retainer bushing to releasably and interchangeably secure and seal the sealing plug or sensor in place.

* * * * *